United States Patent [19]

Drehobl

[11] 4,455,518

[45] Jun. 19, 1984

[54] CONTROL PROVISION FOR SEPARATING PRINTED MATTER

[75] Inventor: Claus Drehobl, Leipzig, German Democratic Rep.

[73] Assignee: Veb Kombinat Polygraph "Werner Lamberz" Leipzig, Leipzig, German Democratic Rep.

[21] Appl. No.: 328,096

[22] Filed: Dec. 7, 1981

[30] Foreign Application Priority Data

Dec. 12, 1980 [DD] German Democratic Rep. ... 225989

[51] Int. Cl.[3] ..... G05D 23/275

[52] U.S. Cl. ..... 318/632; 318/571; 271/153

[58] Field of Search ..... 318/632, 621, 39, 571; 271/153, 154, 157

[56] References Cited

U.S. PATENT DOCUMENTS 4,296,365 10/1981 Yoshikawa ..... 318/632

4,345,194 8/1982 Green ..... 318/632 X

*Primary Examiner*—B. Dobeck

*Attorney, Agent, or Firm*—Michael J. Striker

[57] ABSTRACT

A control provision is provided for separating sheets of printed matter. An initiator serves to generate electrical pulses proportional to the transport speed, which are transformed into compensation times depending on the pulses of the operating delay time and of the fall delay time of the servo components, and which are connected to the servo components via coupling elements and following selection or control circuits. A transport means moves the printed material, a distributing guide is operated by the servo components and the sheets to be sorted out are removed independent from the speed of transport and without interference or disturbance of the other sheets.

8 Claims, 2 Drawing Figures

CONTROL PROVISION FOR SEPARATING PRINTED MATTER

DESCRIPTION

BACKGROUND OF THE INVENTION

1. Field of the Invention

The invention relates to a control provision for separating of printed material from a stream of continuously transported products in machines for treating and processing of printed materials.

2. Brief Description of the Background of the Invention Including Prior Art

German Disclosure Document DE-AS No. 22 29 414 teaches a provision for sorting of discards from a stream of folded printed materials, where the pieces to be sorted out are moved away with a distributing guide inserted at an inclined angle into the feed stream, which distributing guide can only be moved in its longitudinal direction back and forth. The insertion of the distributing guide into the feed stream is performed on a stream feed tape, which operates with an increased speed relative to the transport bands. In order to achieve a back and forth motion of the distributing guide as fast as possible, the motion is provided by an electrically controlled compressed air cylinder.

Furthermore, apparatus for the sorting of sheets are known, which change the transport direction of the sample pieces to be sorted out during a sheet gap of the continuous stream by way of a sheet distributing guide and a preceding relais.

It is disadvantageous with these apparatus, that they can function only up to a certain transport speed. The limit of the speed depends on the operating delay time or respectively the fall delay time of the distributing guide.

SUMMARY OF THE INVENTION

1. Purposes of the Invention

It is an object of the present invention to provide a control provision for the sorting of printed materials to be applied at high transport speeds.

It is another object of the present invention to compensate the delay times of the distributing guide electronically.

It is a further object of the present invention to provide an adjustment of the time of motion of the distributing guide depending on the transport speed.

These and other objects and advantages of the present invention will become evident from the description which follows.

2. Brief Description of the Invention

The present invention provides a control provision for the separation of printed material. An initiator provides electrical pulses proportional to the transport speed. A compensation circuit is connected to the initiator for transforming the pulses into signals depending on the pulses and providing compensation time information relating to the fall delay time and to the operating delay time of servo components. Coupling elements are connected to the compensation circuit and a selection circuit is connected to the coupling elements. The selection circuit is connected to servo components and these in turn are operating a distributing guide.

The initiator can be an inductive initiator. The compensation circuit can comprise a monostable multivibrator, an intergator connected to the monostable multivibrator, an inverter connected to the integrator, a one-out-of-n threshold circuit for recognizing set voltages connected to the inverter, a one-out-of-n decoder connected with in each case corresponding inputs to the outputs of the one-out-of-n threshold circuit, a compensation stage for the fall decay time connected to corresponding outputs of the one-out-of-n decoder, a compensation stage for the operating delay time connected to the corresponding outputs of the one-out-of-n decoder, a first NAND-gate having its output connected to the second input of the compensation stage for the fall delay time, a modulo-9 counter having its output connected to the input of the first NAND-gate, an eighth NAND-gate connected to the input of the modulo-9 counter and having an input connected to the inductive initiator, a switching provision connected to the input of the modulo-9 counter and a control circuit connected to the switching provision.

The control provision for separation of sheets or printed materials can further comprise a compensation stage for operating delay time, a second NAND-gate, a switching provision connected to the output of the second NAND-gate together with the output of the compensation stage for the operating delay time and to the output of the compensation stage via the second NAND-gate, a control circuit connected to and started by the switching provision, a third NAND-gate connected to the first input of the second NAND-gate, a fourth NAND-gate connected to the input of the third NAND-gate and to the output of the compensation stage for operating delay time, a second monostable multivibrator connected to the output of the compensation stage for operating delay time, a fifth NAND-gate connected to the output of the second monostable multivibrator, a flip-flop device element having its set input connected to the fifth NAND-gate, a sixth NAND-gate having its output connected to the reset input of the flip-flop device element and having an input connected to the set input of the flip-flop device element, and a seventh NAND-gate having an output connected to the second input of the sixth NAND-gate and having an input connected to the output of the compensation stage.

The control provision for separating can also comprise a flip-flop device element having its output connected to a first protective resistor and having its reset input connected to a second protective resistor, where the coupling element is provided by two optoelectronic couplers and the input of the first optoelectronic coupler is connected to the first protective resistor and the input of the second optoelectronic coupler is connected to the second protective resistor. Preferably the selection circuits are amplifiers and the servo components are provided by electromagnets.

There is also provided a method for separating printed materials with a distributing guide and corresponding servo components which comprises generating electrical pulses proportional to the transport speed with an initiator, transforming the pulses into signals corresponding to the fall delay time and/or operating delay time of the servo components with a compensation circuit, feeding the signals to coupling elements, controlling selection circuits from the coupling elements and feeding the servo components from the selection circuits.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which is shown one of the various possible embodiments of the invention.

DESCRIPTION OF INVENTION AND PREFERRED EMBODIMENTS

Figure 1:
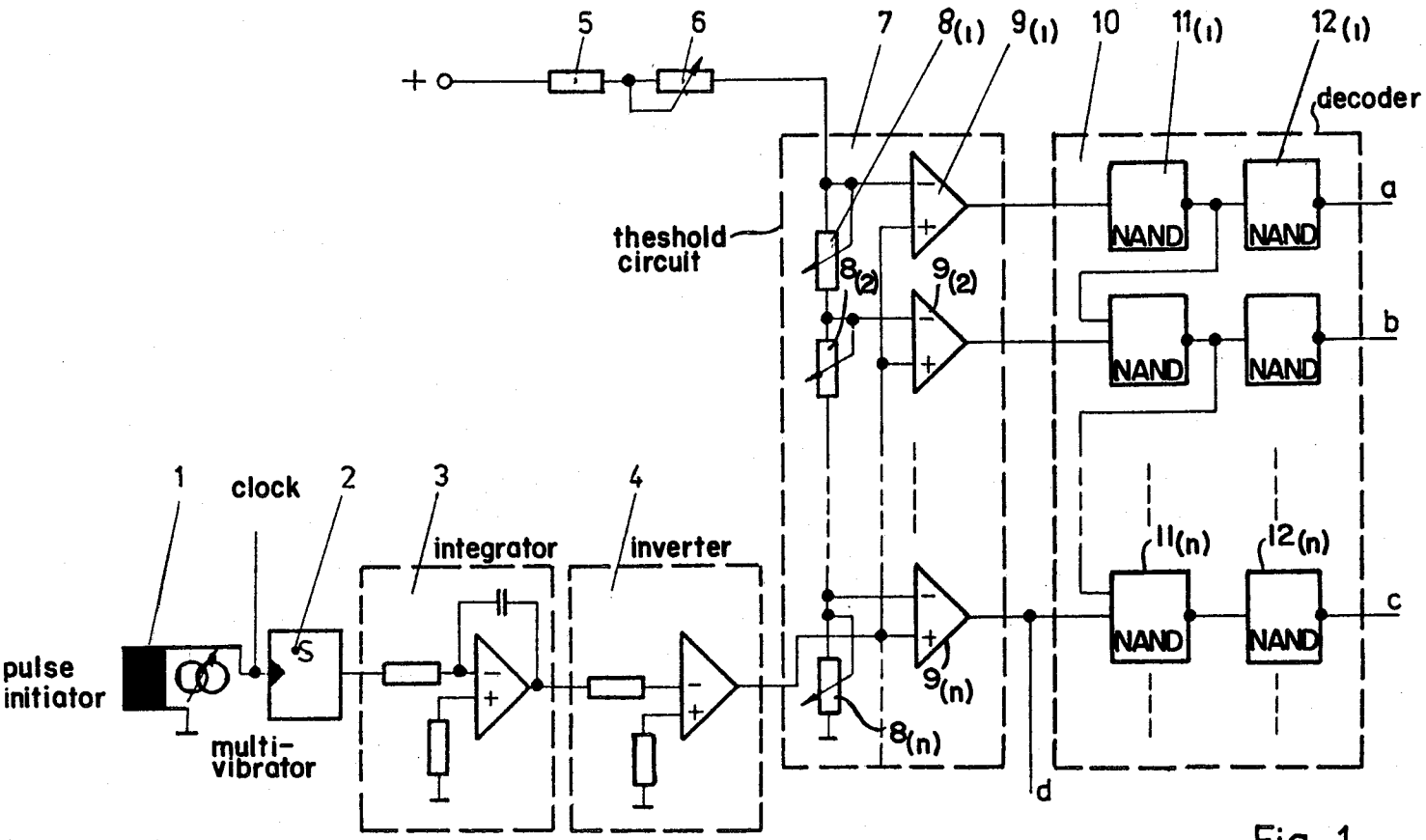
FIG. 1 is a view of a schematic circuit diagramm showing the initial stages of the compensation circuit.
Figure 2:
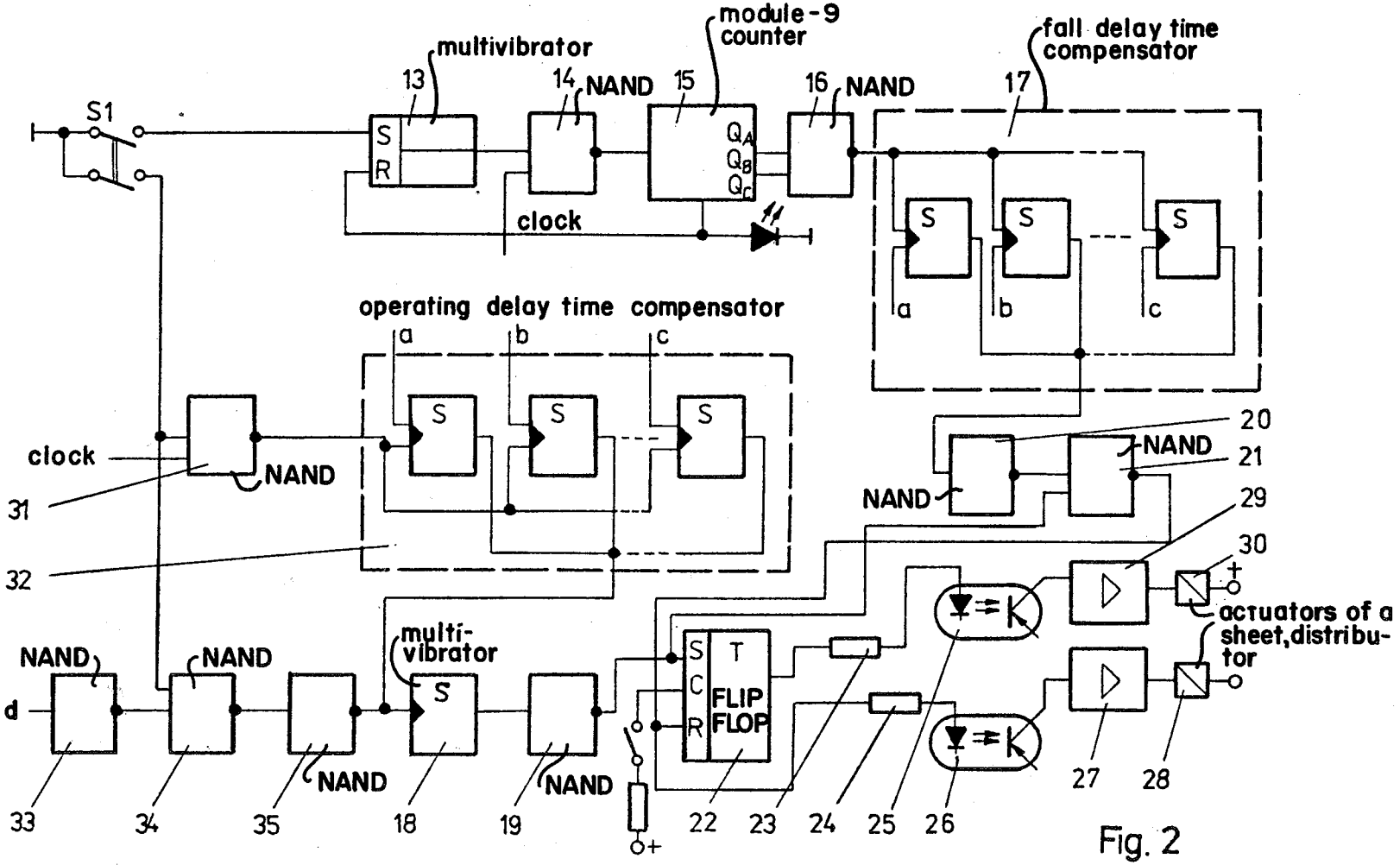
FIG. 2 is a view of a schematic circuit diagram showing the output sections of the compensation circuit.

In accordance with the present invention, the control provision provides for separating of printed matter such that the samples to be sorted out are removed independent from the transport speed and without interference with the transport of the other material.

An initiator generates electrical pulses proportional to the transport speed, a compensation circuit transforms the pulses into compensation times depending on the pulses of the fall delay time and of the operating delay time of the servo components, and the outputs of the compensation circuit are connected via coupling elements and following selection circuits to the servo components.

It is advantageous for a circuit as simple as possible to select the initiator as forming an inductive initiator. It is further advantageous to provide the control provision such that in the compensation circuit a monostable multivibrator is connected with its output to the input of the threshold circuit "one-out-of-n" for the purpose of recognizing set voltage potentials via an inverter following to an integrator and that the outputs of the threshold circuit "one-out-of-n" is connected to the in each case corresponding inputs of a decoder "one-out-of-n" as well as that the outputs of the decoder "one-out-of-n" are connected to the corresponding inputs of a compensation stage for the fall delay time and the corresponding inputs of a compensation stage for the operating delay time. The term "one-out-of-n" denotes a threshold circuit which is freely selectable from a number ("n") of threshold circuits. This number "n" is determined by the required accuracy of measurement of the work speed. The second inputs of the compensation stage for fall delay time are connected together to the output of a NAND-gate. The inputs of the NAND-gate are connected to the outputs of a modulo-9 counter, i.e. a counter with nine unique states, and the input of the modulo-9 counter is connected via a NAND-gate to an inductive initiator as well as to the switching provision serving to provide release of the function of the control circuit. It is preferred as a feature for the control provision that in the compensation circuit the second inputs of the compensation stage for operating delay time are connected together with the output of a NAND-gate and via this NAND-gate to the switching provision serving to release the function of the control circuit. The first input of the NAND-gate can be connected to the output of the compensation stage for operating delay time via a NAND-gate following to a NAND-gate. The output of the compensation stage for operating delay can be connected to the set input of a flip-flop device element via a monostable multivibrator and a following NAND-gate and the reset input of the flip-flop device element can be connected to the set input via a NAND-gate and to the output of the compensation stage for fall delay time via a NAND-gate following to the NAND-gate.

A preferred feature of the coupling circuit between the compensation circuit and the selection circuit for the final control elements comprises that the coupling elements are provided as optoelectronic couplers and that the input of the first optoelectronic coupler is connected to the output of the flip-flop device element via a protective resister as well as the input of the second optoelectronic coupler is connected to the reset input of the flip-flop device element via a protective resistor.

It is an advantage for the selection of the servo components that the selection circuits are provided as amplifiers. With respect to the actual capturing of the fall delay time and of the operating delay time is is advantageous, if the servo components are provided as electromagnets.

The present invention provides for compensation of the fall delay time and of the operating delay time of the servo components of the distributing guide and thus allows an interference free and disturbance free separation of the printed matter under any desired transport speeds.

In the following embodiment, the control provision serves to separate a certain number of sheets from a continuously transported stream in the delivery of a cross cutter. In case of high work speeds the problem arises to switch the sheet ditributing guide lever depending on the work speed such that always a sheet gap is met. The time available for safely meeting a sheet gap for the sheet distributing guide lever differs depending on the work speed. With increasing work speed the "sheet gap time" becomes insufficient for switching the sheet distributing guide lever via its mechnical setting mechanism directly during the "sheet gap time". The operating delay time, that is the time from the moment of turning on the actuating voltage of the magnet up to the start of the armature travel is larger than the available "sheet gap time". If the sheet distributing guide lever is removed again, then the same problems arises. Now the fall delay time is larger than the "sheet gap time" being available.

It is the purpose of the control provision in this case to compensate the operating delay time and the fall delay time of the servo components by coordinating to the magnet a certain (speed dependent) preset value.

The operation of the circuit is as follows. The speed of the knife shaft of the cross cutter is transformed into electrical pulses by way of a contactless inductive initiator 1. These pulses are transformed into pulses with constant pulse duration by the following monostable multivibrator 2 (first monostable multivibrator). The following integrator 3 transforms the digital signals into analog voltages proportional to the work speed. The inverter 4 serves to provide proper potential adaptation to the following stages. The integrated voltage passes from the output of the inverter 4 to the threshold circuit ("one-out-of-n") 7. The supply voltage for the non-inverted inputs of the operational amplifier 9 is adjusted via the dropping resistor 5 and the potentiometer 6. The values of the individual input voltages at the non-inverting inputs of the individual operational amplifiers are adjusted with the potentiometers 8 corresponding in each case to the inputs. They generate a stepwise increasing reference voltage.

The number "n" of operational amplifier stages $8_{(1)}$, $9_{(1)}$ to $8_{(n)}$, $9_{(n)}$ contained in the threshold switch ("one-out-of-n") 7 depends on the accuracy required for the work speed to be measured. The integrated analog d.c.-voltage corresponding to the work speed of the cross cutter passes via the output of the inverter 4 to all second inputs of the operational amplifiers 9. If this voltage is larger than the first reference voltage, then the first operational amplifier $9_{(1)}$ switches at its output to TTL-level. If the voltage value becomes larger than the reference voltage at the second operational amplifier $9_{(2)}$, then the first and second operational amplifiers $9_{(1)}$, $9_{(2)}$ switch at their outputs to TTL-level and so on. Depending on the number of operational amplifiers which have switched, a corresponding number of the inputs of the following decoder 10("one-out-of-n") are fed with an H-signal. It is the purpose of the decoder 10("one-out-of-n") to determine the switched operational amplifier stage 8,9 having the highest reference voltage. This is achieved within the decoder 10("one-out-of-n") through the connection of the first and second NAND-gate 11, 12 per decoder stage and by connecting the output of the first NAND-gate $11_{(1)}$ to the first input of the first NAND-gate $11_{(2)}$ of the next decoder stage. Corresponding to the in each case determined operational amplifier stage 8,9 the output a, b, or c has an H-signal. This H-signal passes now to the coordinated input of the compensation stage for the fall delay time 17 and the compensation stage for the operating delay time 32. The compensation stages 17, 32 comprise monostable multivibrators S having different hold times. Depending on how fine the steps of the hold times are required, this also determines the number of monostable multivibrators. The function of the compensation stage 17 for the fall delay time is released via the two pole switch S1 through the bistable multivibrator 13, the NAND-gate 14 (eighth NAND-gate), the modulo-9 counter 15 and the NAND-gate 16 (first NAND-gate) on the one hand. On the other hand the function of the compensation stage for the operating delay time 32 is released via the NAND-gate 31 (second NAND-gate). The optoelectronic coupler 25 is controlled furthermore via the output d of the threshold circuit ("one-out-of-n") 7, which corresponds to a work speed of the cross cutter, the NAND-gate 33, the NAND-gate 34 (third NAND-gate) providing the connection between the output d and the switch S1, the NAND-gate 35 (fourth NAND-gate), the monostable multivibrator 18 (second monostable multivibrator) and the NAND-gate 19 (fifth NAND-gate) as well as via the set input of the flip-flop device element 22 and the protective resistor 23. The control of the optoelectronic coupler 25 effects on its secondary side a response of the amplifier 29 and thus a response of the electromagnet 30, which switches the sheet distributing guide. After the actuation of the switch S1 the bistable multivibrator 13 is set and the L-signal at its output passes via the NAND-gate 14 (eighth NAND-gate) together with the clock or cycle signal of the inductive initiator 1 to the input of the modulo-9 counter 15. This counter counts to a preset number of sheets and effects via the NAND-gate 16 (first NAND-gate) the release of the compensation stage for the fall delay time 17. The signal at the output of the compensation stage for the fall delay time 17 passes via the NAND-gates 20, 21 (sixth NAND-gate and seventh NAND-gate) to the reset input of the flip-flop device element 22 and effects at the same time the control of the optoelectronic coupler 26 via the protective resistor 24. On the secondary side the electromagnet 28 is thereby actuated via the amplifier 27, which effects the reverse switching of the sheet distributing guide.

It will be understood that each of the elements described above, or two or more together, may also find a useful application in order types of system configurations and sorting procedures differing from the types described above.

While the invention has been illustrated and described in the context of a control apparatus for sorting of printed materials, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Control provision for the separation of printed material movable at a transport speed past a distributing guide, comprising servo components for operating the distributing guide;

an initiator providing electrical pulses proportional to the transport speed;

a compensation circuit connected to the initiator for transforming the pulses into signals depending on the pulses and providing compensation time information relating to the fall delay time and the operating delay time of the servo components;

coupling elements connected to the compensation circuit; and selection circuit connected to the coupling elements and to the servo components.

2. The control provision for separation according to claim 1 wherein the initiator is an inductive initiator.

3. The control provision for separation according to claim 2 wherein the compensation circuit comprises a monostable multivibrator;

an integrator connected to the monostable multivibrator;

an inverter connected to the integrator;

a one-out-of-n threshold circuit for recognizing set voltages connected to the inverter;

a one-out-of-n decoder connected with in each case corresponding inputs to the outputs of the one-out-of-n threshold circuit;

a compensation stage for the fall decay time connected to corresponding outputs of the one-out-of-n decoder;

a compensation stage for the operating delay time connected to the corresponding outputs of the one-out-of-n decoder;

a first NAND-gate having its output connected to the second input of the compensation stage for the fall delay time;

a modulo-9 counter having its output connected to the input of the first NAND-gate;

an eighth NAND-gate connected to the input of the modulo-9 counter and having an input connected the inductive initiator;

a switching provision connected to the input of the modulo-9 counter; and a control circuit connected to the switching provision.

4. The control provision for separation according to claim 1 further comprising a compensation stage for operating delay time;

a second NAND-gate;

a switching provision connected to the output of the second NAND-gate together with the output of the compensation stage for the operating delay time and to the output of the compensation stage via the second NAND-gate;

a control circuit connected to and started by the switching provision;

a third NAND-gate connected to the first input of the second NAND-gate; a fourth NAND-gate connected to the input of the third NAND-gate and to the output of the compensation stage for operating delay time;

a second monostable multivibrator connected to the output of the compensation stage for operating delay time;

a fifth NAND-gate connected to the output of the second monostable multivibrator;

a flip-flop device element having its set input connected to the fifth NAND-gate;

a sixth NAND-gate having its output connected to the reset input of the flip-flop device element and having an input connected to the set input of the flip-flop device;

a seventh NAND-gate having an output connected to the second input of the sixth NAND-gate and having an input connected to the output of the compensation stage.

5. The control provision for separation according to claim 1 further comprising a flip-flop device element;

a first protective resistor connected to the output of the flip-flop device element;

a second protective resistor connected to the reset input of the flip-flop device element;

wherein the coupling element is provided by two optoelectronic couplers and the input of the first optoelectronic coupler is connected to the first protective resistor and the input of the second optoelectronic coupler is connected to the second protective resistor.

6. The control provision for separation according to claim 1 wherein the selection circuits are amplifiers.

7. The control provision for separation according to claim 1 wherein the servo components are provided by electromagnets.

8. A method for separating printed materials with a distributing guide and corresponding servo components comprising:

generating electrical pulses proportional to the transport speed with an initiator;

transforming the pulses into signals corresponding to the fall delay time and/or operating delay time of the servo components with a compensation circuit;

feeding the signals to coupling elements;

controlling selection circuits from the coupling elements; and feeding the servo components from the selection circuits.

* * * * *